US012601546B2

(12) United States Patent
Marrero Ortiz et al.

(10) Patent No.: US 12,601,546 B2
(45) Date of Patent: Apr. 14, 2026

(54) HYBRID FLOW HEAT EXCHANGERS

(71) Applicant: Cummins Inc., Columbus, IN (US)

(72) Inventors: Victor Luis Marrero Ortiz, Yabucoa, PR (US); Taren DeHart, Columbus, IN (US); Jacob W. Brown, Columbus, IN (US); Brett A. Boas, Columbus, IN (US); Stephen Joseph Waymeyer, Batavia, OH (US)

(73) Assignee: Cummins Inc., Columbus, IN (US)

( * ) Notice: Subject to any disclaimer, the term of this patent is extended or adjusted under 35 U.S.C. 154(b) by 345 days.

(21) Appl. No.: 18/305,703

(22) Filed: Apr. 24, 2023

(65) Prior Publication Data

US 2023/0258409 A1 Aug. 17, 2023

Related U.S. Application Data

(63) Continuation of application No. PCT/US2021/072031, filed on Oct. 26, 2021.

(60) Provisional application No. 63/106,084, filed on Oct. 27, 2020.

(51) Int. Cl.
*F28D 7/10* (2006.01)

(52) U.S. Cl.
CPC ..... *F28D 7/10* (2013.01)

(58) Field of Classification Search
CPC ..... F28D 7/10; F28D 9/00
USPC ..... 165/154
See application file for complete search history.

(56) References Cited

U.S. PATENT DOCUMENTS

| | | | | |
|---|---|---|---|---|
| 3,712,370 | A | 1/1973 | Gilli et al. | |
| 3,831,674 | A | 8/1974 | Stein et al. | |
| 3,997,002 | A | 12/1976 | Baker et al. | |
| 4,178,991 | A | 12/1979 | Bieri | |
| 5,571,424 | A * | 11/1996 | Ahluwalia | B01J 3/042 588/317 |

(Continued)

FOREIGN PATENT DOCUMENTS

| | | |
|---|---|---|
| DE | 102012107908 | 3/2014 |
| JP | 2007046890 A | 2/2007 |

(Continued)

OTHER PUBLICATIONS

International Search Report and Written Opinion for International patent application No. PCT/US2021/072031, mailed Apr. 2, 2022, 10 pgs., 10.

*Primary Examiner* — Davis D Hwu
(74) *Attorney, Agent, or Firm* — Taft, Stettinius & Hollister LLP

(57) ABSTRACT

One embodiment is a heat exchanger comprising a shell surrounding a first fluid plenum, a plurality of flow chamber walls positioned inside the shell, and a diffuser positioned inside the shell. The plurality of flow chamber walls: at least partially define a plurality of first fluid radial flow channels in flow communication with a first fluid inlet and the first fluid plenum, at least partially define a plurality of second fluid axial flow channels in flow communication with a second fluid inlet, and comprise an arcuate shape and arranged in an array to at least partially define arcuate shapes of the first fluid radial flow channels and the second fluid axial flow channels. The diffuser includes a diffuser surface at least partially defining a diffusion flow path from the first fluid inlet and the plurality of first fluid radial flow channels.

27 Claims, 5 Drawing Sheets

(56) References Cited

U.S. PATENT DOCUMENTS

| | | | |
|---|---|---|---|
| 9,394,813 | B2 | 7/2016 | Geminn |
| 10,088,250 | B2 | 10/2018 | Turney |
| 2008/0020247 | A1 | 1/2008 | Valensa et al. |
| 2013/0021301 | A1 | 1/2013 | Chen |
| 2017/0248050 | A1 | 8/2017 | Ohrem et al. |

FOREIGN PATENT DOCUMENTS

| | | |
|---|---|---|
| JP | 2013152048 | 8/2013 |
| WO | 02063231 | 8/2002 |

* cited by examiner

HYBRID FLOW HEAT EXCHANGERS

CROSS-REFERENCE

The present application is a continuation of continuation of International Application No. PCT/US2021/72031 filed Oct. 26, 2021 which claims priority to and the benefit of U.S. Application No. 63/106,084, filed Oct. 27, 2020, which is hereby incorporated by reference.

BACKGROUND

The present disclosure relates generally to heat exchangers which operate to exchange heat between a first fluid flow and a second fluid flow. Such heat exchangers may be utilized in connection with a number of applications and systems. In the context of engine systems, for example, such heat exchangers may be utilized as exhaust gas recirculation (EGR) coolers, exhaust waste heat recovery heat exchangers, and in other applications where heat transfer between a first fluid and a second fluid is performed. While useful, existing designs for such heat exchangers suffer from a number of drawbacks and limitations. There remains a longstanding need for the unique apparatuses, systems, methods, and techniques disclosed herein.

DISCLOSURE OF EXAMPLE EMBODIMENTS

For the purposes of clearly, concisely and exactly describing example embodiments of the present disclosure, the manner, and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created and that the invention includes and protects such alterations, modifications, and further applications of the exemplary embodiments as would occur to one skilled in the art.

SUMMARY

One embodiment is a unique heat exchanger. In some forms, the heat exchanger is configured or provided as an EGR cooler. In some forms, the heat exchanger is configured or provided as an exhaust waste heat recovery heat exchanger. Further embodiments, forms, objects, features, advantages, aspects, and benefits shall become apparent from the following description and drawings.

DETAILED DESCRIPTION

Figure 1:
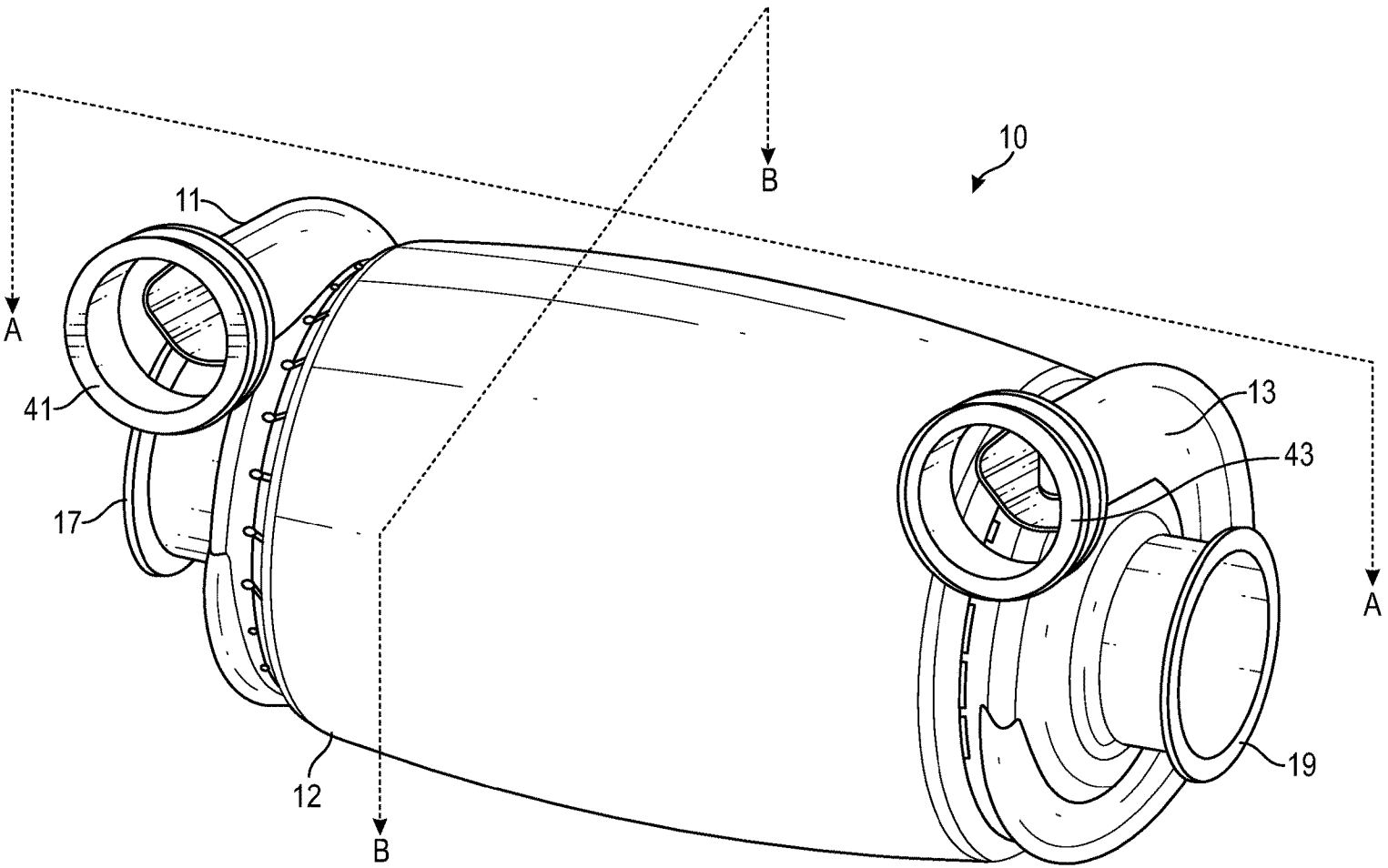
FIG. 1 is a perspective view depicting certain aspects of a heat exchanger according to an example embodiment.
Figure 1A:
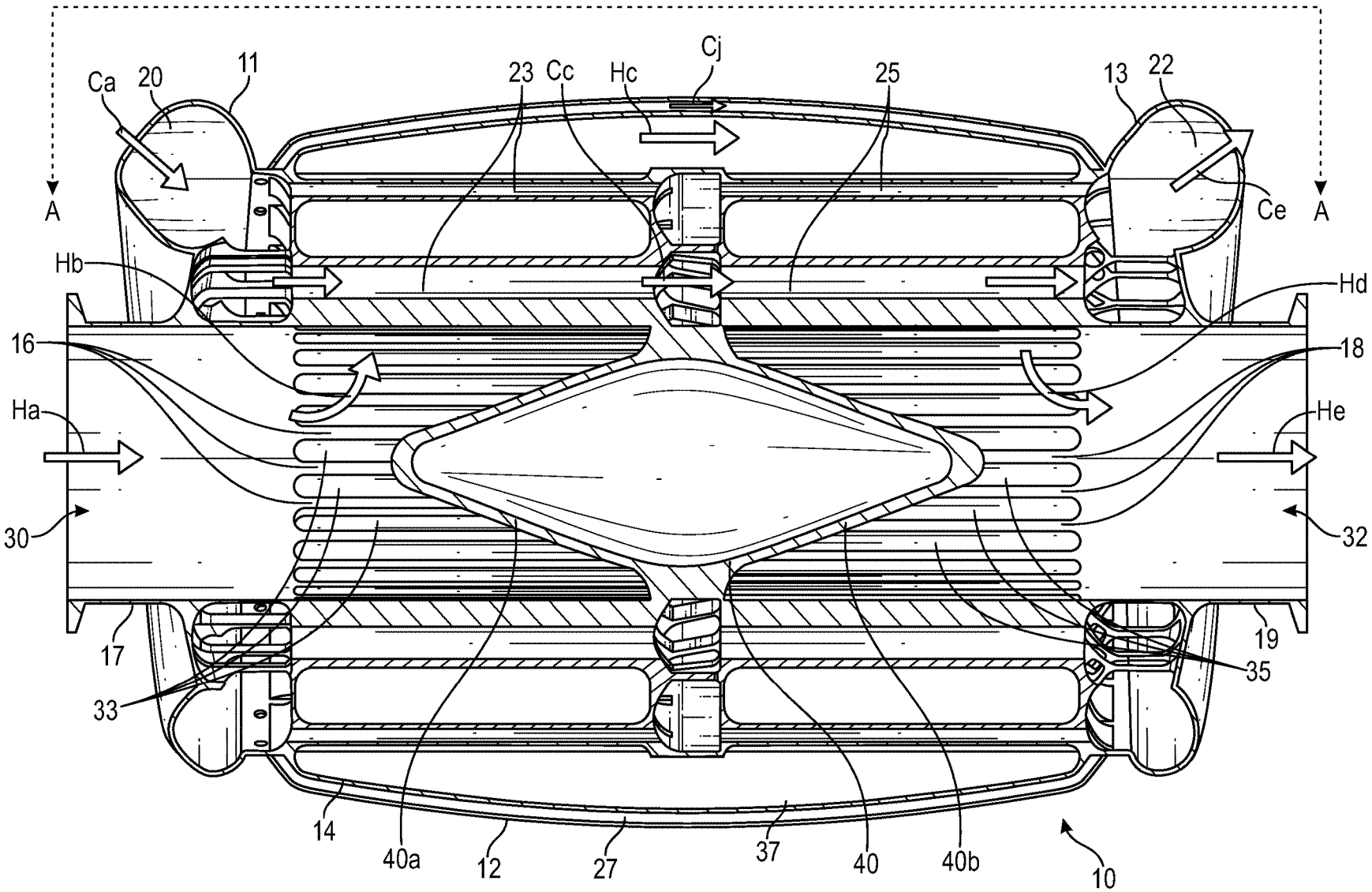
FIG. 1A is a sectional perspective view of the heat exchanger of FIG. 1 taken along the line A-A.
Figure 1B:
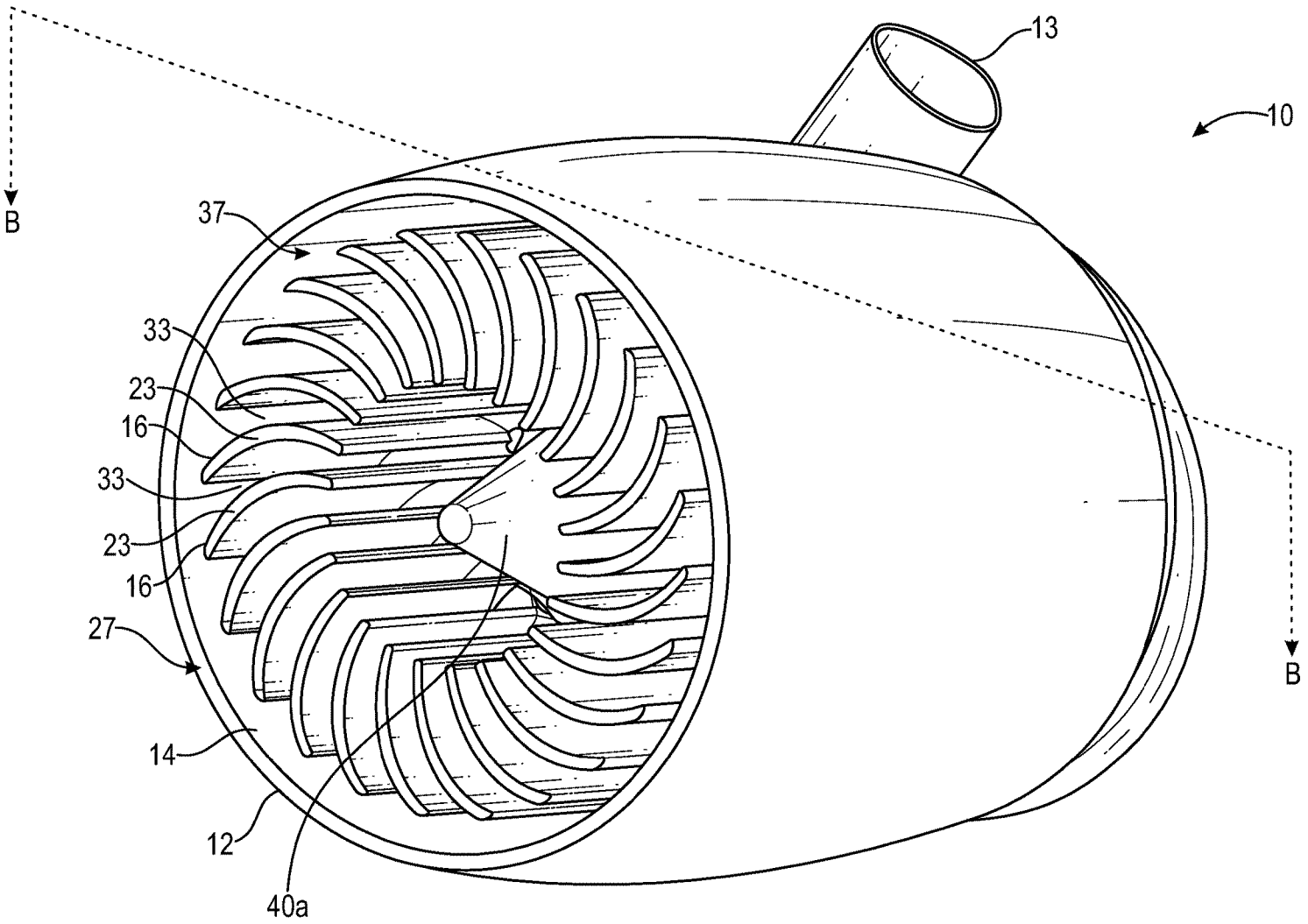
FIG. 1B is a sectional perspective view of the heat exchanger of FIG. 1 taken along the line B-B.

With reference to FIGS. 1, 1A, and 1B there is illustrated an example embodiment (sometimes referred to herein as "the illustrated embodiment") of a heat exchanger according to the present disclosure. In the illustrated embodiment, the heat exchanger is configured as an EGR cooler 10 which is installable in an EGR flow path of a reciprocating piston internal combustion engine system, for example, as illustrated in connection with FIG. 2. In other embodiments, the heat exchanger may be adapted, configured, or modified for other applications, for example, as an exhaust waste heat recovery heat exchanger of a reciprocating piston internal combustion engine system. In further embodiments, the disclosed heat exchangers, and adaptations, reconfigurations, or modifications thereof, may be utilized in applications where heat transfer between a first fluid and a second fluid is performed in connection with ground transportation systems, marine transportation systems, internal combustion reciprocating engine systems, internal combustion reciprocating engine generator assembly systems, and in the components of such systems. Examples of such applications include heat exchangers configured to or operable to perform heat transfer between a first fluid and a second fluid in connection with fuel systems, turbocharger systems, air handling systems, filtration systems, exhaust treatment systems, and powertrain electrification systems and components, such cooling systems or thermal management systems for powertrain batteries, powertrain fuel cells, powertrain power electronics, and other types of powertrain electrification components as would occur to one of skill in the art with the benefit of the present disclosure. Thus, while the example embodiment of FIG. 1 is illustrated and described as an EGR cooler which is configured to couple with an EGR flow path and a coolant flow path of an engine system, heat exchangers according to the present disclosure are not so limited unless expressly so stated. It shall also be appreciated that the terms "hot" or "hot fluid flow" and "cool" or "cool fluid flow" refer to a relative temperature difference between a first fluid flow and a second fluid flow through a heat exchanger and are not limited to any particular temperatures or temperature ranges unless expressly so stated.

EGR cooler 10 includes an inner shell 14 surrounding and at least partially defining a hot fluid flow plenum 37 and an outer shell 12 surrounding the inner shell 14 and at least partially defining a cold fluid flow jacket 27. A plurality of flow chamber walls 16, 18 and a diffuser/condenser 40 are also provided within inner shell 14. The plurality of flow chamber walls 16, 18 at least partially define and provide a heat transfer path between respective pluralities of hot fluid radial flow channels 33, 35 and cold fluid axial flow channels 23, 25. Hot fluid radial flow channels 33, 35 are in flow communication with a hot fluid flow inlet 30 (which is bounded by inlet wall 17), a hot fluid flow outlet 32 (which is bounded by outlet wall 19), and the hot fluid flow plenum 37. Reference numerals have been utilized to denote some of the flow chamber walls 16, 18, the hot fluid radial flow channels 33, 35, and the cold fluid axial flow channels 23, 25. It shall be appreciated that the description of these features also applies to the additional illustrated flow chamber walls, hot fluid radial flow channels, and cold fluid axial flow channels which are not labeled with reference numerals to preserve clarity of illustration.

Hot fluid radial flow channels 33 are in flow communication with a hot fluid flow inlet 30 and hot fluid flow plenum 37 such that a flow of hot fluid (in this example recirculated exhaust gasses) proceeds in a generally axial direction through hot fluid flow inlet 30 toward a diffuser 40*a* of diffuser/condenser 40 as generally indicated by arrow Ha. The diffuser 40*a* of diffuser/condenser 40 is structured to diffuse and direct the flow of hot fluid toward hot fluid radial flow channels 33 as generally indicated by arrow Hb. Hot fluid flow within hot fluid radial flow channels 33 proceeds along an arcuate flow path in a generally radially outward direction through hot fluid flow channels 33 to hot fluid flow plenum 37. It should be appreciated that the flow of hot fluid experiences a pressure drop between hot fluid flow inlet 30 and the hot fluid flow plenum 37.

Hot fluid flow proceeds axially through hot fluid flow plenum 37 toward hot fluid radial flow channels 35 as generally indicated by arrow Hc. Hot fluid radial flow channels 35 are in flow communication with hot fluid flow plenum 37 and a hot fluid flow outlet 32. Hot fluid flow proceeds along an arcuate flow path in a generally radially inward direction through hot fluid flow channels 35 toward condenser 40*b* of diffuser/condenser 40 as generally, indicated by arrow Hd, and then proceeds axially along hot fluid flow outlet 32 as generally indicated by arrow He. The flow of hot fluid experiences a pressure increase between hot fluid flow plenum 37 and hot fluid flow outlet 32.

Cold fluid axial flow channels 23 are in flow communication with cold fluid flow inlet 20 as well as with cold fluid flow jacket 27 and cold fluid axial flow channels 23 which are arranged in parallel flow paths. In the illustrated embodiment, cold fluid flow inlet 20 is defined by a volute 11 which directs a flow of cold fluid (in this example engine coolant) to cold fluid axial flow channels 23. A portion of the flow of cold fluid is also directed to cold fluid flow jacket 27. A portion of the flow of cold fluid proceeds from cold fluid axial flow channels 23 to cold fluid axial flow channels 25. The flow of cold fluid from cold fluid axial flow channels 25 and cold fluid flow jacket 27 proceeds to cold fluid flow outlet 22, which, in the illustrated embodiment, cold fluid flow inlet 20 is defined by a volute 13.

In the illustrated embodiment, diffuser 40*a* and condenser 40*b* of diffuser/condenser 40 are provided in one example form of a generally conical shape, namely a spherically blunted conic shape. Other embodiments may include diffusers and condensers with a variety of generally conical geometries including, for example, simple conics, other blunted conics, bi-conic, tangent ogive, spherically blunted tangent ogive, secant ogive, elliptical, parabolic, power series, or Haack series, among other generally conical geometries.

In the illustrated embodiment, the arcuate shape and arrangement of the plurality of flow chamber walls 16 at least partially defines a clockwise (relative to an end view in the axial flow direction) array of the arcuate shapes of the first fluid radial flow channels and the second fluid axial flow channels, and the arcuate shape of the plurality of flow chamber walls 18 at least partially defines a counterclockwise (relative to an end view in the axial flow direction) array of the arcuate shapes of the second fluid radial flow channels and the second fluid axial flow channels. In other embodiments, the arcuate shapes and arrangements of a first plurality of flow chamber walls and an axially spaced apart second plurality of flow chamber walls may be oriented in the opposite direction, i.e., the first plurality of flow chamber walls may define a counterclockwise array of the arcuate shapes, and the second plurality of flow chamber walls may define a clockwise array. In other embodiments, the arcuate shapes and arrangements of a first plurality of flow chamber walls and an axially spaced apart second plurality of flow chamber walls may both define either a clockwise or a counterclockwise array of arcuate shapes, i.e., the arcuate shapes may be oriented in the same direction. In other embodiments, only one of the first plurality of flow chamber walls and an axially spaced apart second plurality of flow chamber walls may define an arcuate shape.

In the illustrated embodiment, the arcuate shapes of the plurality of flow chamber walls 16, 18 are configured in one example form of a generally spiral shape, namely as segments of an involute of a circle. In other embodiments, the arcuate shapes of the plurality of flow chamber walls 16, 18 may be configured in a variety of generally spiral shapes including, for example, as segments of a circle, other types of involutes, an Archimedean spiral, a logarithmic spiral, a parabolic spiral, a hyperbolic spiral, or a Fibonacci spiral, among other generally spiral shapes. In the illustrated embodiment, the arcuate shape of the plurality of flow chamber walls and the second plurality of flow chamber walls are provided in the same type of spiral shapes. In other embodiments, the arcuate shapes of the plurality of flow chamber walls 16, 18 may be provided in different spiral shapes from one another.

In the illustrated embodiment, the cold fluid flow inlet 20, the hot fluid flow inlet 30 and the plurality of flow chamber walls 16, 18 are arranged to provide one example of a hybrid fluid flow, namely an axially-parallel flow, radially-cross flow configuration of the first fluid and the second fluid. In other embodiments, the first fluid inlet, the second fluid inlet and the plurality of flow chamber walls are arranged to provide other examples of a hybrid fluid flow, for example, an axially-counter flow, radially cross-flow configuration of the first fluid and the second fluid. In the illustrated embodiment, the plurality of flow chamber walls are arranged to provide a coolant swirl in an opposite direction from gas swirl to promote heat transfer as well as a parallel flow effect from axial flow direction.

In the illustrated embodiment, the inner shell 14 is surrounded by an outer shell 12 define a cold fluid flow jacket 27 intermediate the inner shell 14 and the outer shell 12. In other embodiments, the outer shell 12 and the cold fluid flow jacket 27 may be omitted. Inclusion of an outer shell and cold fluid flow jacket may be preferred in certain applications, such as EGR applications, which receive high-temperature fluids (e.g., exhaust at 1000° F. or greater). In such applications, portions of a heat exchanger that are exposed to the highest temperatures (e.g., the exhaust flow inlet) or the highest temperature gradients (e.g., the portions of the heat exchanger where the highest temperature exhaust encounters to lowest temperature coolant) experience greater thermal expansion and stress which can result in fatigue and cracking. Use of an outer shell and cold fluid flow jacket can distribute coolant to cool such portions of the heat exchanger and provide more uniform coolant flow/distribution lower stresses.

In the illustrated embodiment, the plurality of flow chamber walls 16, 18 are configured with generally smooth surfaces facing or bounding the hot fluid flow and the cold fluid flow. In other embodiments, one or both of the flow chamber walls, or other arrangements of flow chamber walls such as those described herein, may be provided with different surfaces or surface features facing or bounding the hot fluid flow and the cold fluid flow. For example, one or both of the surfaces facing or bounding the hot fluid flow and the cold fluid flow may comprise waves, undulations, fins, bumps, projections, or other physical features or textures configured to increase the surface area of the plurality of flow chamber walls and/or impart turbulence into one or both of the hot fluid flow and the cold fluid flow. In some embodiments, these features may include fins having additional turbulence features provided thereon, such as compound fins, or fins on fins.

In some embodiments, one or both of the plurality of flow chamber walls 16, 18, or other arrangements of flow chamber walls such as those described herein, may comprise a sub-macro surface roughness on at least one of a surface facing the flow first fluid and a surface facing the flow of second fluid. In some embodiments one or both of the plurality of flow chamber walls may comprise a multi-material co-sinter portion providing a surface or coating that is adapted for the particular fluid encountered by a given surface, for example, a surface facing an EGR gas flow may be provided with a ceramic material (e.g., alumina), polymer coatings, a combination of ceramic (e.g., alumina) and a catalyst (e.g., Pt, Pd, or another oxidation catalyst).

In the illustrated embodiment, the cross-sectional area between adjacent ones of the plurality of flow chamber walls 16, 18 and the cross-sectional of the interior chambers of the plurality of flow chamber walls 16, 18 have been tailored to provide a predetermined combination of back pressure reduction and heat transfer capacity. Thus, the cross-sectional area of these regions varies as the hot fluid flow and the cold fluid flow proceed through the heat exchanger and, for example, to match a change in fluid density provide desired mass flow density and pressure characteristics. For example, along the arcuate path in the radial direction the cross-sectional areas of the plurality of flow chamber walls 16, 18 increase.

Additional embodiments may include a number of other features. For example, applications such as aftertreatment heat exchangers may be configured to provide equal flow areas. In some such embodiments, the diffuser cones may be positioned to condense fluid flow at the inlet and diffuse fluid flow at an outlet in combination with a toroidal flow spiraling toward the center of the heat exchanger. Other embodiment may include two-pass or multi-pass arrangements.

EGR cooler 10 can be manufactured using additive manufacturing processes and techniques, examples of which are disclosed in U.S. application Ser. No. 15/261,547, filed Sep. 9, 2016, entitled REVERSIBLE BINDERS FOR USE IN BINDER JETTING ADDITIVE MANUFACTURING TECHNIQUES, and published as US 2018/0071820 A1 on Mar. 15, 2018. These and other additive manufacturing processes and techniques may be utilized to produce heat exchangers with smaller and more geometrically complex channels and features relative to other manufacturing processes and techniques as well as to provide heat exchangers with a greater cooling capacity to mass or cooling capacity to volume ratio.

Figure 2:
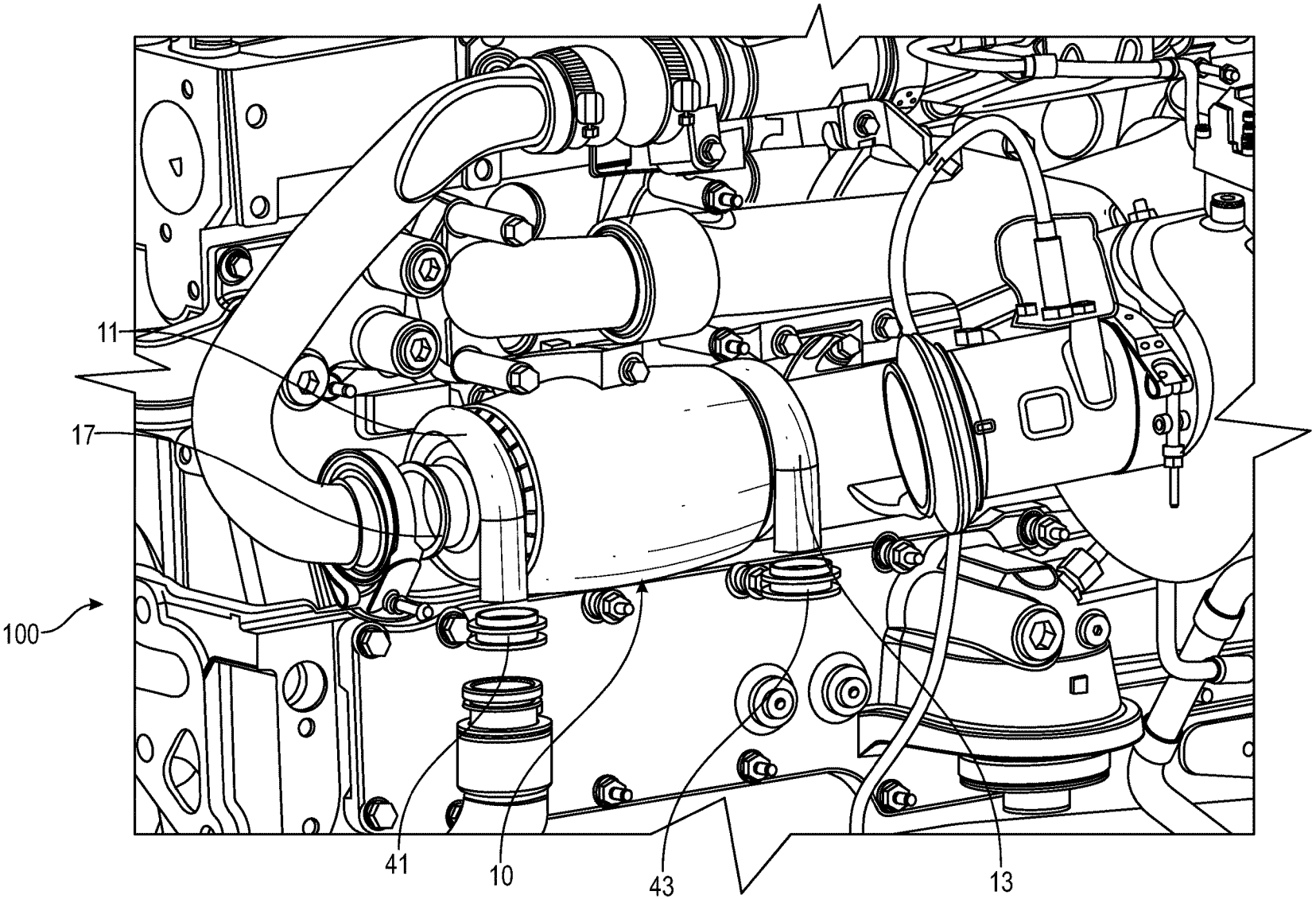
FIG. 2 illustrates the heat exchanger of FIG. 1 in connection with an example engine system.

With reference to FIG. 2, there is illustrated an example of EGR cooler 10 installed in an EGR flow path of an engine system 100. In the illustrated embodiment the hot fluid flow inlet 30 of EGR cooler 10 is configured to operatively couple with a conduit that receives recirculated exhaust gas from the engine system 100 using coupling rings or clamps 41, and hot fluid flow outlet 32 of EGR cooler 10 is configured to operatively couple with a conduit that provides recirculated exhaust gasses to an intake of engine system 100 (e.g., to an intake manifold) using coupling rings or clamps 43. Furthermore, cold fluid flow inlet 20 is configured to operatively couple with a conduit providing engine coolant, and cold fluid flow outlet 22 is configured to operatively couple with a conduit receiving engine coolant.

Figure 3:
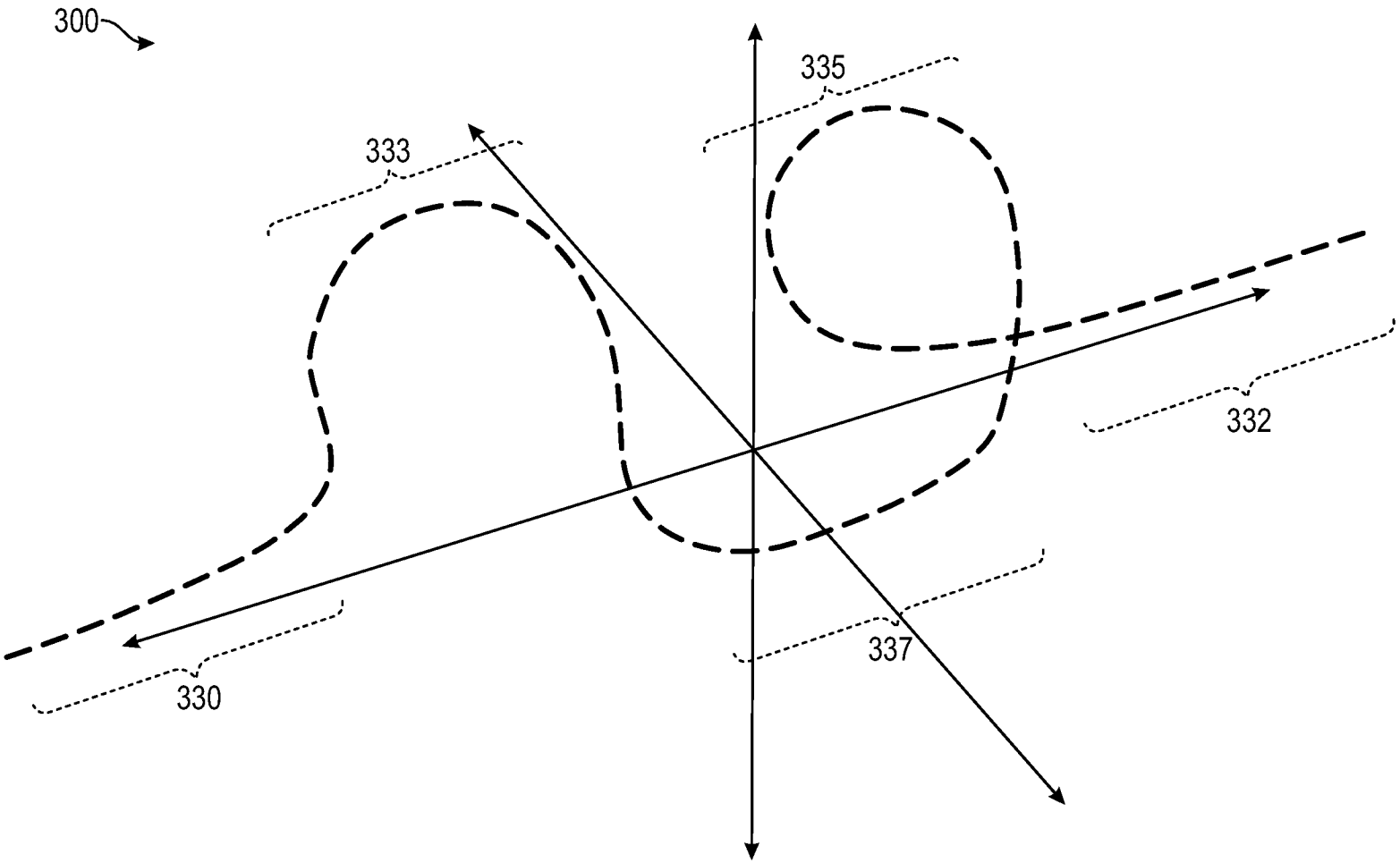
FIG. 3 illustrates an example of a hot fluid flow path through the heat exchanger of FIG. 1.

With reference to FIG. 3, there is illustrated a curve 300 depicting an example hot fluid flow path through the EGR cooler 10 of FIG. 1. Certain portions of curve 300 illustrating fluid flow through the hot fluid flow inlet 30 are labeled 330. Certain portions of curve 300 illustrating fluid flow through hot fluid radial flow channels 33 are labeled 333. Certain portions of curve 300 illustrating flow through hot fluid flow plenum 37 are labeled 337. Certain portions of curve 300 illustrating flow through hot fluid radial flow channels 35 are labeled 335. Certain portions of curve 300 illustrating flow through the hot fluid flow outlet 32 are labeled 332.

A number of example embodiments according to the present disclosure are now additionally described. A first embodiment is a heat exchanger comprising: a shell surrounding a first fluid plenum; a plurality of flow chamber walls positioned inside the shell, the plurality of flow chamber walls: at least partially defining a plurality of first fluid radial flow channels in flow communication with a first fluid inlet and the first fluid plenum, at least partially defining a plurality of second fluid axial flow channels in flow communication with a second fluid inlet, being in thermal communication with and structured to exchange heat between the plurality of first fluid radial flow channels and the plurality of second fluid axial flow channels, and arranged in an array to at least partially define the plurality of first fluid radial flow channels and the plurality of second fluid axial flow channels; and a diffuser positioned inside the shell and including a diffuser surface at least partially defining a diffusion flow path from the first fluid inlet and the plurality of first fluid radial flow channels.

A second embodiment is a heat exchanger according to the first embodiment, wherein the plurality of flow chamber walls comprise arcuate shapes.

A third embodiment is a heat exchanger according to the second embodiment, wherein the plurality of flow chamber walls at least partially define corresponding arcuate shapes of the plurality of first fluid radial flow channels and the plurality of second fluid axial flow channels.

A fourth embodiment is a heat exchanger according to the second embodiment, wherein the arcuate shapes of the plurality of flow chamber walls comprise involute shapes.

A fifth embodiment is a heat exchanger according to the first embodiment comprising: a second plurality of flow chamber walls positioned inside the shell, the second plurality of flow chamber walls: at least partially defining a second plurality of first fluid radial flow channels in flow communication with the first fluid plenum and a first fluid outlet, at least partially defining a second plurality of second fluid axial flow channels in flow communication with the second fluid inlet and the second fluid outlet, and the plurality of second fluid radial flow channels, being in thermal communication with and structured to exchange heat between the second plurality of first fluid radial flow channels and the second plurality of second fluid axial, and arranged in a second array to at least partially define the second plurality of first fluid radial flow channels and the second plurality of second fluid axial flow channels; and a condenser positioned inside the shell and including a condenser surface at least partially defining a condenser flow path from the plurality of second fluid radial flow channels to the first fluid outlet.

A sixth embodiment is a heat exchanger according to the fifth embodiment, wherein the second plurality of flow chamber walls comprise arcuate shapes.

A seventh embodiment is a heat exchanger according to the sixth embodiment, wherein the second plurality of flow chamber walls at least partially define corresponding arcuate shapes of the second plurality of first fluid radial flow channels and the second plurality of second fluid axial flow channels.

An eighth embodiment is a heat exchanger according to the sixth embodiment, wherein the arcuate shapes of the second plurality of flow chamber walls comprise involute shapes.

A ninth embodiment is a heat exchange according to the sixth embodiment, wherein the arcuate shape of the plurality of flow chamber walls at least partially defines one of a clockwise array and a counterclockwise array of the arcuate shapes of the first fluid radial flow channels and the second fluid axial flow channels.

A tenth embodiment is a heat exchanger according to the ninth embodiment, wherein the arcuate shape of the second plurality of flow chamber walls at least partially defines the other of the clockwise array and the counterclockwise array of the arcuate shapes of the second fluid radial flow channels and the second fluid axial flow channels.

An eleventh embodiment is according to the second embodiment, wherein the arcuate shape of the plurality of flow chamber walls at least partially defines one of a clockwise array and a counterclockwise array of the arcuate shapes of the first fluid radial flow channels and the second fluid axial flow channels, and the arcuate shape of the second plurality of flow chamber walls at least partially defines said one of the clockwise array and the counterclockwise array of the arcuate shapes of the second fluid radial flow channels and the second fluid axial flow channels.

A twelfth embodiment is a heat exchanger according to any of the first through eleventh embodiments, wherein the first fluid inlet, the second fluid inlet, and the plurality of flow chamber walls are arranged to provide an axially-parallel flow, radially-cross flow configuration of the first fluid and the second fluid.

A thirteenth embodiment is a heat exchanger according to any of the first through twelfth embodiments, wherein the first fluid inlet, the second fluid inlet, and the plurality of flow chamber walls are arranged to provide an axially-counter flow, radially cross-flow configuration of the first fluid and the second fluid.

A fourteenth embodiment is a heat exchanger according to any of the first through thirteenth embodiments, wherein the shell is surrounded by a second shell to define a cold fluid flow jacket intermediate the shell and the second shell.

A fifteenth embodiment is a heat exchanger according to any of the first through fourteenth embodiments, wherein the plurality of flow chamber walls comprises waves defined on at least one of a surface facing the flow first fluid and a surface facing the flow of second fluid.

A sixteenth embodiment is a heat exchanger according to any of the first through fifteenth embodiments, wherein the plurality of flow chamber walls comprises fins extending out from at least one of a surface facing the flow first fluid and a surface facing the flow of second fluid.

A seventeenth embodiment is a heat exchanger according to any of the first through sixteenth embodiments, wherein the plurality of flow chamber walls comprises a sub-macro surface roughness on at least one of a surface facing the flow first fluid and a surface facing the flow of second fluid.

An eighteenth embodiment is a heat exchanger according to any of the first through seventeenth embodiments, wherein the heat exchanger is configured as an EGR cooler, the first fluid comprises recirculated exhaust gasses, and the second fluid flow comprises engine coolant.

A nineteenth embodiment is a heat exchanger according to any of the first through eighteenth embodiments, wherein the heat exchanger is configured as a waste heat recovery heat exchanger, the first fluid comprises exhaust gasses, and the second fluid comprises a liquid coolant.

A twentieth embodiment is a method comprising: providing a heat exchanger including: a shell surrounding a first fluid plenum, a plurality of flow chamber walls positioned inside the shell, the plurality of flow chamber walls at least partially defining a plurality of first fluid radial flow channels in flow communication with a first fluid inlet and the first fluid plenum, at least partially defining a plurality of second fluid axial flow channels in flow communication with a second fluid inlet, being in thermal communication with and structured to exchange heat between the plurality of first fluid radial flow channels and the plurality of second fluid axial flow channels, and arranged in an array to at least partially define the plurality of first fluid radial flow channels and the plurality of second fluid axial flow channels, and a diffuser positioned inside the shell and including a diffuser surface at least partially defining a diffusion flow path from the first fluid inlet and the plurality of first fluid radial flow channels; flowing a first fluid from the first fluid inlet to the diffuser, through the diffuser, from the diffuser to the plurality of first fluid radial flow channels, through the plurality of first fluid radial flow channels, and from the plurality of first fluid radial flow channels to the first fluid plenum; and flowing a second fluid from the second fluid inlet to the plurality of second fluid axial flow channels and through the plurality of second fluid axial flow channels effective to exchange heat between the plurality of first fluid radial flow channels and the plurality of second fluid axial flow channels.

A twenty-first embodiment is a method according to the twentieth embodiment, wherein flowing the first fluid through the plurality of first fluid radial flow channels comprises flowing the first fluid along a plurality of arcuate flow paths.

A twenty-second embodiment is a method according to the twentieth embodiment, wherein the plurality of arcuate flow paths comprise involute arcuate flow paths.

A twenty-third embodiment is a method according to the twentieth embodiment, comprising: providing the heat exchanger including a second plurality of flow chamber walls positioned inside the shell, the second plurality of flow chamber walls at least partially defining a second plurality of first fluid radial flow channels in flow communication with the first fluid plenum and a first fluid outlet, at least partially defining a second plurality of second fluid axial flow channels in flow communication with the second fluid inlet and the second fluid outlet, and the plurality of second fluid radial flow channels, being in thermal communication with and structured to exchange heat between the second plurality of first fluid radial flow channels and the second plurality of second fluid axial, and arranged in a second array to at least partially define the second plurality of first fluid radial flow channels and the second plurality of second fluid axial flow channels, and a condenser positioned inside the shell and including a condenser surface at least partially defining a condenser flow path from the plurality of second fluid radial flow channels to the first fluid outlet; flowing the first fluid from the plenum to the second plurality of first fluid radial flow channels, through the second plurality of first fluid radial flow channels to the condenser, through the condenser, and from the condenser to the first fluid outlet; and flowing the second fluid from the plurality of second fluid axial flow channels to the second plurality of second fluid axial flow channels, through the second plurality of second fluid axial flow channels effective to exchange heat between the second plurality of first fluid radial flow channels and the second plurality of second fluid axial flow channels, and from the second plurality of second fluid axial flow channels to the second fluid outlet.

A twenty-fourth embodiment is a method according to the twenty-third embodiment, wherein flowing the first fluid through the second plurality of first fluid radial flow channels comprises flowing the first fluid along a second plurality of arcuate flow paths.

A twenty-fourth embodiment is a method according to the twenty-third embodiment, wherein the second plurality of arcuate flow paths comprise second involute arcuate flow paths.

While example embodiments of the disclosure have been illustrated and described in detail in the drawings and foregoing description, the same is to be considered as illustrative and not restrictive in character, it being understood that only certain exemplary embodiments have been shown and described and that all changes and modifications that come within the spirit of the claimed inventions are desired to be protected. It should be understood that while the use of words such as preferable, preferably, preferred or more preferred utilized in the description above indicates that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A heat exchanger comprising:

a shell surrounding a first fluid plenum;

a plurality of flow chamber walls positioned inside the shell, the plurality of flow chamber walls:

at least partially defining a plurality of first fluid radial flow channels in flow communication with a first fluid inlet and the first fluid plenum, at least partially defining a plurality of second fluid axial flow channels in flow communication with a second fluid inlet, being in thermal communication with and structured to exchange heat between the plurality of first fluid radial flow channels and the plurality of second fluid axial flow channels, and arranged in an array to at least partially define the plurality of first fluid radial flow channels and the plurality of second fluid axial flow channels; and a diffuser positioned inside the shell and including a diffuser surface at least partially defining a diffusion flow path from the first fluid inlet and the plurality of first fluid radial flow channels.

2. The heat exchanger of claim 1, wherein the plurality of flow chamber walls comprise arcuate shapes.

3. The heat exchanger of claim 2, wherein the plurality of flow chamber walls at least partially define corresponding arcuate shapes of the plurality of first fluid radial flow channels and the plurality of second fluid axial flow channels.

4. The heat exchanger of claim 2 wherein the arcuate shapes of the plurality of flow chamber walls comprise involute shapes.

5. The heat exchanger of claim 1 comprising:

a second plurality of flow chamber walls positioned inside the shell, the second plurality of flow chamber walls:

at least partially defining a second plurality of first fluid radial flow channels in flow communication with the first fluid plenum and a first fluid outlet, at least partially defining a second plurality of second fluid axial flow channels in flow communication with the second fluid inlet and a second fluid outlet, and the plurality of second fluid radial flow channels, being in thermal communication with and structured to exchange heat between the second plurality of first fluid radial flow channels and the second plurality of second fluid axial, and arranged in a second array to at least partially define the second plurality of first fluid radial flow channels and the second plurality of second fluid axial flow channels; and a condenser positioned inside the shell and including a condenser surface at least partially defining a condenser flow path from the plurality of second fluid radial flow channels to the first fluid outlet.

6. The heat exchanger of claim 5, wherein the second plurality of flow chamber walls comprise arcuate shapes.

7. The heat exchanger of claim 6, wherein the second plurality of flow chamber walls at least partially define corresponding arcuate shapes of the second plurality of first fluid radial flow channels and the second plurality of second fluid axial flow channels.

8. The heat exchanger of claim 6, wherein the arcuate shapes of the second plurality of flow chamber walls comprise involute shapes.

9. The heat exchanger of claim 6, wherein the arcuate shape of the plurality of flow chamber walls at least partially defines one of a clockwise array and a counterclockwise array of the arcuate shapes of the first fluid radial flow channels and the second fluid axial flow channels.

10. The heat exchanger of claim 9, wherein the arcuate shape of the second plurality of flow chamber walls at least partially defines the other of the clockwise array and the counterclockwise array of the arcuate shapes of the second fluid radial flow channels and the second fluid axial flow channels.

11. The heat exchanger of claim 2 wherein the arcuate shapes of the plurality of flow chamber walls at least partially defines one of a clockwise array and a counterclockwise array of the arcuate shapes of the first fluid radial flow channels and the second fluid axial flow channels, and the arcuate shape of the second plurality of flow chamber walls at least partially defines said one of the clockwise array and the counterclockwise array of the arcuate shapes of the second fluid radial flow channels and the second fluid axial flow channels.

12. The heat exchanger of claim 1, wherein the first fluid inlet, the second fluid inlet, and the plurality of flow chamber walls are arranged to provide an axially-parallel flow, radially-cross flow configuration of the first fluid and the second fluid.

13. The heat exchanger of claim 1, wherein the first fluid inlet, the second fluid inlet, and the plurality of flow chamber walls are arranged to provide an axially-counter flow, radially cross-flow configuration of the first fluid and the second fluid.

14. The heat exchanger of claim 1, wherein the shell is surrounded by a second shell to define a cold fluid flow jacket intermediate the shell and the second shell.

15. The heat exchanger of claim 1, wherein the plurality of flow chamber walls comprises waves defined on at least one of a surface facing the flow first fluid and a surface facing the flow of second fluid.

16. The heat exchanger of claim 1, wherein the plurality of flow chamber walls comprises fins extending out from at least one of a surface facing the flow first fluid and a surface facing the flow of second fluid.

17. The heat exchanger of claim 1, wherein the plurality of flow chamber walls comprises a sub-macro surface roughness on at least one of a surface facing the flow first fluid and a surface facing the flow of second fluid.

18. The heat exchanger of claim 1, wherein the heat exchanger is configured as an EGR cooler, the first fluid comprises recirculated exhaust gasses, and the second fluid flow comprises engine coolant.

19. The heat exchanger of claim 1, wherein the heat exchanger is configured as a waste heat recovery heat exchanger, the first fluid comprises exhaust gasses, and the second fluid comprises a liquid coolant.

20. A method comprising:

providing a heat exchanger including: a shell surrounding a first fluid plenum, a plurality of flow chamber walls positioned inside the shell, the plurality of flow chamber walls at least partially defining a plurality of first fluid radial flow channels in flow communication with a first fluid inlet and the first fluid plenum, at least partially defining a plurality of second fluid axial flow channels in flow communication with a second fluid inlet, being in thermal communication with and structured to exchange heat between the plurality of first fluid radial flow channels and the plurality of second fluid axial flow channels, and arranged in an array to at least partially define the plurality of first fluid radial flow channels and the plurality of second fluid axial flow channels, and a diffuser positioned inside the shell and including a diffuser surface at least partially defining a diffusion flow path from the first fluid inlet and the plurality of first fluid radial flow channels;

flowing a first fluid from the first fluid inlet to the diffuser, through the diffuser, from the diffuser to the plurality of first fluid radial flow channels, through the plurality of first fluid radial flow channels, and from the plurality of first fluid radial flow channels to the first fluid plenum; and flowing a second fluid from the second fluid inlet to the plurality of second fluid axial flow channels and through the plurality of second fluid axial flow channels effective to exchange heat between the plurality of first fluid radial flow channels and the plurality of second fluid axial flow channels.

21. The method of claim 20, wherein flowing the first fluid through the plurality of first fluid radial flow channels comprises flowing the first fluid along a plurality of arcuate flow paths.

22. The method of claim 20, wherein the plurality of arcuate flow paths comprise involute arcuate flow paths.

23. The method of claim 20, comprising:

providing the heat exchanger including a second plurality of flow chamber walls positioned inside the shell, the second plurality of flow chamber walls at least partially defining a second plurality of first fluid radial flow channels in flow communication with the first fluid plenum and a first fluid outlet, at least partially defining a second plurality of second fluid axial flow channels in flow communication with the second fluid inlet and the second fluid outlet, and the plurality of second fluid radial flow channels, being in thermal communication with and structured to exchange heat between the second plurality of first fluid radial flow channels and the second plurality of second fluid axial, and arranged in a second array to at least partially define the second plurality of first fluid radial flow channels and the second plurality of second fluid axial flow channels, and a condenser positioned inside the shell and including a condenser surface at least partially defining a condenser flow path from the plurality of second fluid radial flow channels to the first fluid outlet;

flowing the first fluid from the plenum to the second plurality of first fluid radial flow channels, through the second plurality of first fluid radial flow channels to the condenser, through the condenser, and from the condenser to the first fluid outlet; and flowing the second fluid from the plurality of second fluid axial flow channels to the second plurality of second fluid axial flow channels, through the second plurality of second fluid axial flow channels effective to exchange heat between the second plurality of first fluid radial flow channels and the second plurality of second fluid axial flow channels, and from the second plurality of second fluid axial flow channels to the second fluid outlet.

24. The method of claim 23, wherein flowing the first fluid through the second plurality of first fluid radial flow channels comprises flowing the first fluid along a second plurality of arcuate flow paths.

25. The method of claim 23, wherein the second plurality of arcuate flow paths comprise second involute arcuate flow paths.

26. The heat exchanger of claim 1, wherein the plurality of flow chamber walls maintain separation of first fluid flow through the plurality of first fluid radial flow channels from second fluid flow through the second fluid axial flow channels.

27. The method of claim 20, comprising: maintaining separation, by the plurality of flow chamber walls, of first fluid flow through the plurality of first fluid radial flow channels from second fluid flow through the second fluid axial flow channels.

* * * * *